United States Patent [19]

Graves

[11] 4,155,284

[45] May 22, 1979

[54] PIANO AND SOUNDBOARD THEREFOR

[75] Inventor: Howard K. Graves, Cleveland, Ohio

[73] Assignee: Krakauer Bros., Inc., Berlin, Ohio

[21] Appl. No.: 825,570

[22] Filed: Aug. 18, 1977

[51] Int. Cl.[2] ..... G10C 3/06

[52] U.S. Cl. ..... 84/187; 84/192

[58] Field of Search ..... 84/184–196

[56] References Cited

U.S. PATENT DOCUMENTS 489,232 1/1893 Reed ..... 84/192

FOREIGN PATENT DOCUMENTS 427761 4/1935 United Kingdom ..... 84/189

*Primary Examiner*—Lawrence R. Franklin

[57] ABSTRACT

A piano construction providing significantly improved tonal quality and balance by utilizing a soundboard which is tightly coupled to the string frame along the top edge and the two side edges of the soundboard except for a loose coupling adjacent the end of the bridge in the treble section along one of the side edges and which soundboard is loosely coupled along the lower edge as the latter is normally positioned in an upright piano. Additionally, a massive support rib on the string frame adjacently extends along the top edge of the soundboard to improve tone, and the strings at their upper ends are held in V-notches at tangential points about the string circumference to avoid lateral vibration. The string frame and soundboard are designed to produce a partially free diaphragmatic-type operation free of soundboard dead spots which maximizes tonal qualities for the dimensional restrictions of small pianos.

6 Claims, 7 Drawing Figures

PIANO AND SOUNDBOARD THEREFOR

BACKGROUND OF THE INVENTION

This invention relates to a piano and a soundboard therefor. Upright pianos and small grand pianos have been basically unable to achieve the tonal quality and balance of larger grand pianos. This is due in a large measure to the size limitation imposed upon smaller pianos.

Problems arise in conventional smaller pianos because of limitations on obtaining the best speaking length of strings in view of the limitation of string length and soundboard size. The speaking length of strings particularly in the bass is often less than desirable because the bridge of the piano cannot be placed too close to a glued edge. While cantilevered bridges have been used in the bass this introduces other problems. Also, soundboards often vibrate with dead spots, and as a result, upright pianos normally have shallow basses and treble.

PRIOR ART STATEMENT

Copies of the following patents were enclosed with the original application papers:

| | | |
|---|---|---|
| Re 26,984 | Graves | May 26, 1970 |
| 491,877 | Duggan | February 14, 1893 |
| 2,229,440 | Carlisle | January 21, 1941 |
| 3,204,508 | Ultes, Jr. | September 7, 1965 |
| 3,511,125 | Graves | May 12, 1970. |

Graves U.S. Pat. No. Re. 26,894 shows a depending projection from an upper piano string frame portion, but the projection does not follow the string speaking length termini along a complete string scale, nor is there disclosed a loosely coupled soundboard bottom edge with the adjacent edges thereto being fixed.

Graves U.S. Pat. No. 3,511,125 discloses a piano soundboard having three free edges.

Carlisle U.S. Pat. No. 2,229,440 discloses a piano soundboard supported around the periphery either by a resilient coupling or a pivoted coupling.

Ultes, Jr. U.S. Pat. No. 3,204,508 discloses agraffes to position the strings in proper alignment.

Duggan U.S. Pat. No. 491,877 shows an agraffe with diamond shaped string holes with beveled edges to provide two points of contact.

It is common practice in piano constructions to define one end of the speaking length of a string by means of a terminus device comprising a generally V-shaped element attached to or cast integrally with a string plate or by means of an agraffe. In most instances, such devices have been formed so that they, in effect, provide a broad somewhat flat or arcuate edge having, at any given instant, a single area of contact with a string. The structure has been such that the string, at the edge, has been free to pivot in a plane generally perpendicular to the edge of the terminus device, and also to vibrate laterally of such plane in a direction extending generally along the length of the edge. Furthermore, the curvature or radius of the edge of heretofore commonly used terminus devices has usually been substantially larger than the radius of the string and such that not only does the area of engagement with the string extend for an increment longitudinally of the string, but also the area of engagement shifts back and forth in the direction of the string length as the string vibrates. It is believed that such lateral vibration of the string along the edge of the terminus device and the variable longitudinal area of string support contribute to the generation of tones and overtones which are undesirable. In addition, it is believed that such terminus devices tend to frictionally restrain the string unnecessarily with a slip-stitch action which tends to excite the strings longitudinally and further generate undesirable clang tones.

SUMMARY OF THE PRESENT INVENTION

The present invention is related to providing a piano construction which provides significantly improved tonal quality and balance in a small piano.

The piano construction utilizes a soundboard construction which is tightly coupled to the frame along the edges of the soundboard except for a loose coupling along the bottom edge as the latter is normally positioned in an upright piano, and a loose coupling in one side edge adjacent the end of the bridge in the treble section. In addition, the string terminus is a V-shaped support which provides tangential support for the strings with some downbearing at the terminus adjacent the pin plank in the treble section; the strings are arranged in a diagonal fashion, as is conventional to obtain greater length, and are parallel to each other; the frame is preferably constructed in such a manner as to provide strength and a cast rib is provided adjacent V-blocks which are the termini for the speaking length of strings to improve tonal quality; the soundboard extends beyond the ends of the string in the middle and treble sections of the piano, and a single bridge is utilized which extends along the string pin line of the frame opposite the tuning pins. The construction and reinforcing ribs for the soundboard produces a partially free diaphragmatic-type operation which is essentially free of vibrational dead spots.

BRIEF DESCRIPTION OF THE DRAWINGS

The foregoing summary of invention is illustrated by the following description of a preferred embodiment with reference to the accompanying drawings, wherein.

DESCRIPTION OF PREFERRED EMBODIMENT

Figure 1:
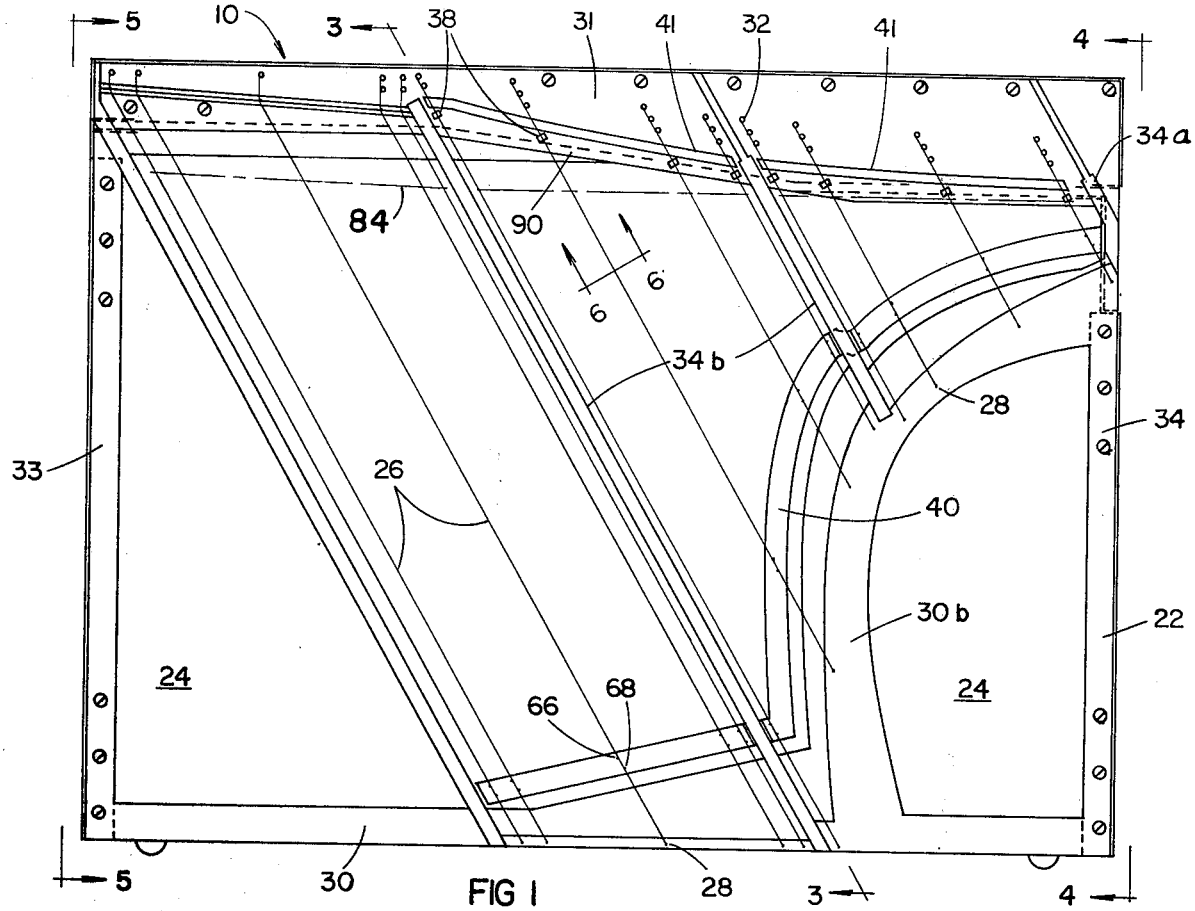
FIG. 1 is a simplified layout view showing a piano construction incorporating features of the present invention.
Figure 3:
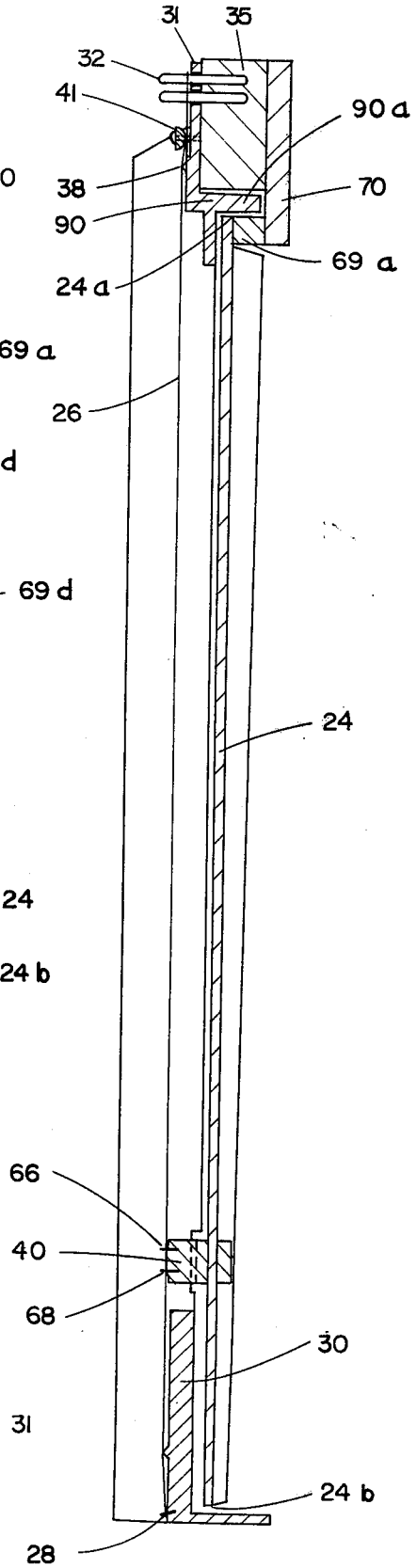
FIG. 3 is a cross-sectional view taken along line 3—3 of FIG. 1.

Referring more specifically to the drawings wherein like parts are designated by the same numerals throughout the drawings, a piano construction 10, incorporating features of the present invention, is shown in FIGS. 1 and 3 as including a string frame 22 and a soundboard 24. In the embodiment shown, the string frame 22 and soundboard 24 are particularly suitable for use in an upright piano.

The string frame is cast and comprises plate-like members providing lower frame portion 30, a top frame portion 31, a bass vertical side portion 33 and treble side portion 34 and compression members 34*a*.

Strings 26 extend diagonally on the string frame and extend between hitch pins 28 fixed to the lower portion 30 and a curved portion 30*b* of the string frame 22 on one hand and tuning pins 32 mounted in a pin plank 35 (FIG. 3) secured to the top portion 31 of the string frame 22. The strings may be conventional piano strings.

In accordance with a feature of the present invention, the speaking length of at least the intermediate and treble strings is determined at the upper end by terminus devices or V-blocks 38 described in more detail below and at the opposite end by the pins in a bridge 40. The string supporting surfaces of the V-blocks 38 and the bridge 40 are preferably disposed substantially in a common plane parallel to the soundboard 24. A pressure bar 41 (FIGS. 1 and 3) is positioned between the tuning pins 32 and the terminus V-blocks 38 and the strings pass underneath the pressure bar to hold the strings against the V-blocks and control the downbearing of the strings at the V-blocks.

Figure 6:
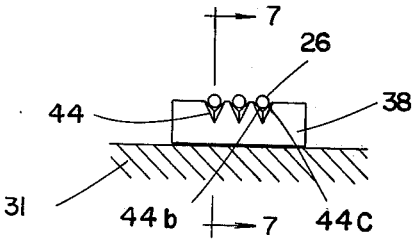
FIG. 6 is an enlarged sectional view taken generally along line 6—6 of FIG. 1.
Figure 7:
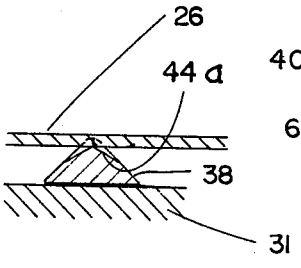
FIG. 7 is a sectional view taken generally along line 7—7 of FIG. 6.

In accordance with conventional practices, three strings are used for each tone in the intermediate and treble portions of the piano. As schematically indicated in FIG. 1, a separate V-block is provided for each string or group of strings used for each tone. Thus, each V-block, as shown in FIGS. 6–7, is adapted to support and determine the speaking length of three strings as is used in the intermediate and treble portions of the piano. The V-blocks are individually and rigidly secured to the upper plate-like portion 31 of string frame 22. The securing of the V-blocks to the string frame 22 can be accomplished by conventional fastening means, such as adhesives or screws.

Each of the V-blocks 38 is preferably provided wih a generally V-shaped cross-sectional configuration as shown in FIG. 7. Each V-block is formed with a separate generally V-shaped notch, or seat, 44 for each string 26.

Each V-shaped notch has an inverted V-shaped bottom 44*a* formed by the line of intersection of the sides of the notch, with the apex of the inverted V being at the center of the notch. Each of the sides of the notch has side portions 44*b*, 44*c* which intersect along a line 44*a* at the center of the notch to define an included angle of less than 180°. The line of intersection 44*a* of the side portions of each side of the notch lies in a common plane with the line of intersection of the side portions of the other side and the apex of the inverted V-shaped bottom. This plane extends perpendicular to the soundboard. The width and depth of each notch is such that the lines of intersection of the side portions of each side engage the string along a tangent line and so that the string does not engage the bottom of the notch.

Figure 2:
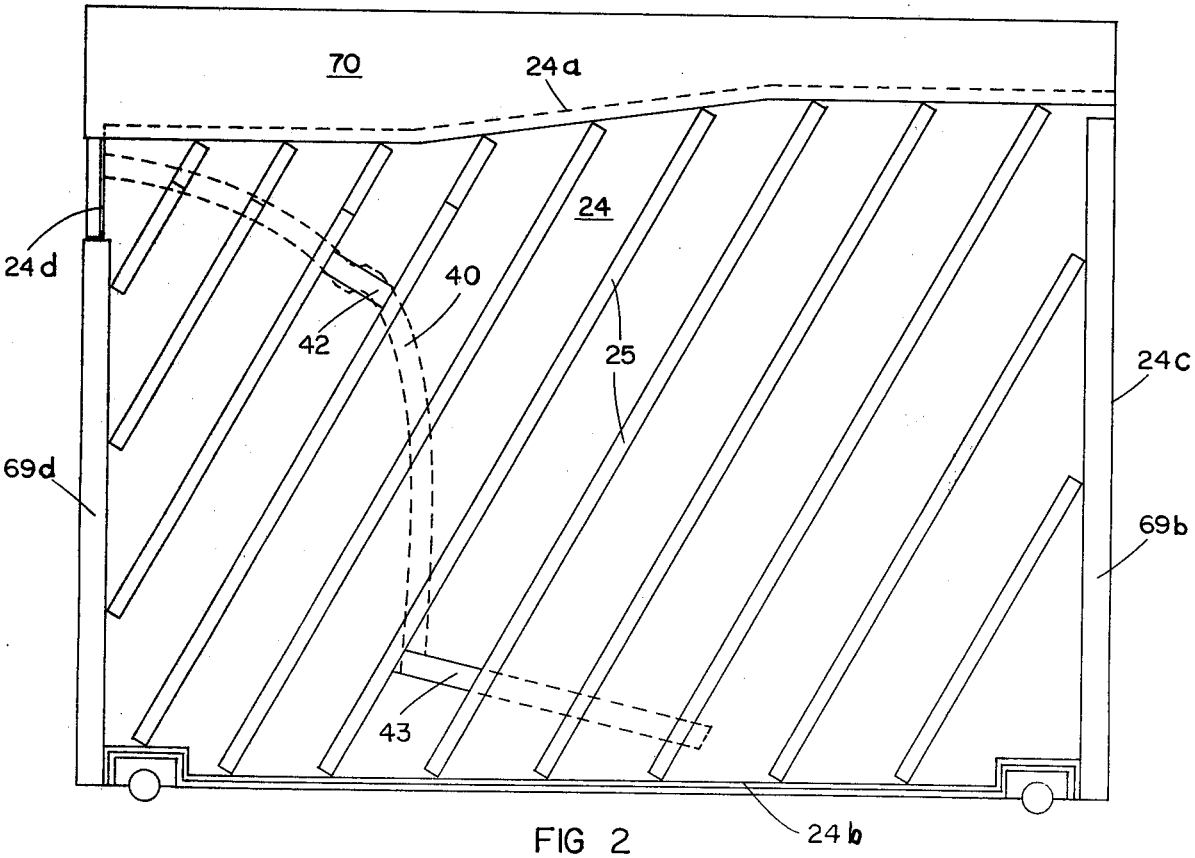
FIG. 2 is a plan view of the rear face of a piano construction incorporating features of the present invention.

With reference to FIGS. 1–3, the bridge 40 is glued or otherwise secured to soundboard 24. The bridge is approximately S-shaped and extends along the soundboard adjacent the line of hitch pins 28. As best seen in FIG. 2, bridge 40 is reinforced by reinforcing blocks 42 and 43 at the notches in the bridge which accommodates compression members 34*b*.

The soundboard 24 is reinforced by reinforcing ribs 25 which extend diagonally across the rear side of the soundboard in a direction perpendicular to the grain direction of the soundboard and generally parallel to the diagonally extending strings 26. The ribs are not attached to the frame of the piano. The strings each engage bridge pins 66 and 68 (FIG. 3) embedded within bridge 40 which preferably are conventional round pins but may be provided with V-shaped laterally facing string notches in the sides of the pins identical in construction to notches 44 described above.

Figure 5:
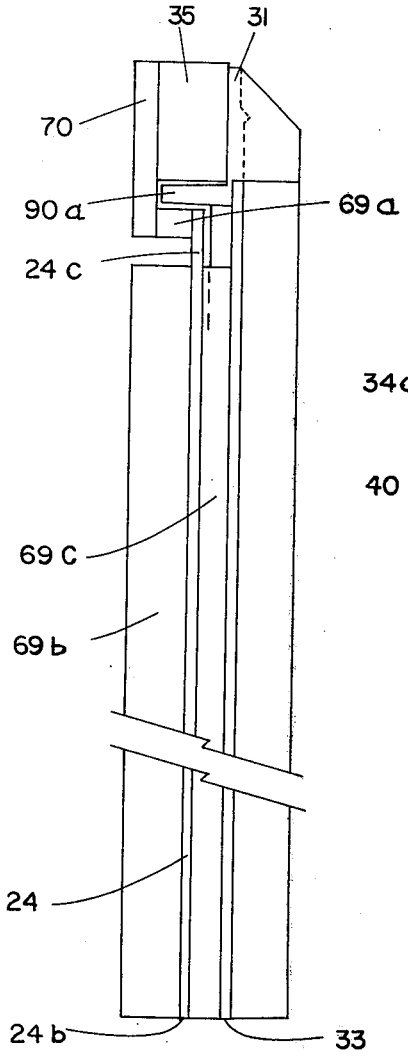
FIG. 5 is a side view taken along line 5—5 of FIG. 1.
Figure 4:
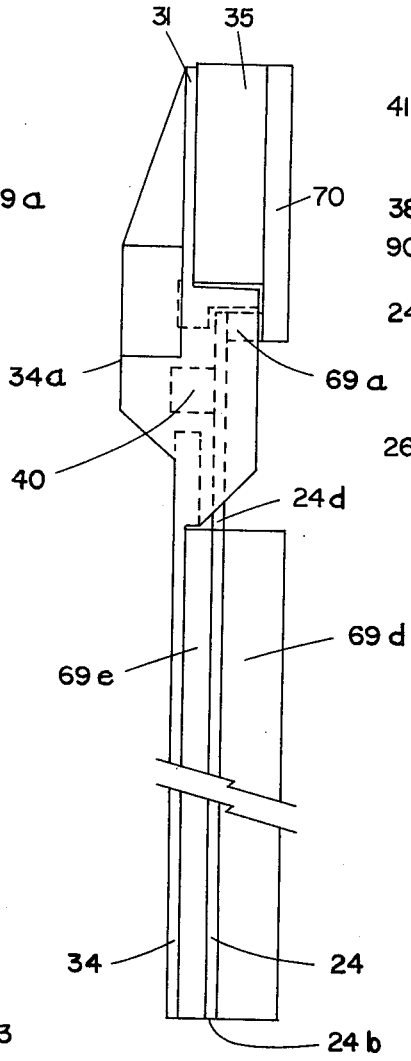
FIG. 4 is a side view taken along line 4—4 of FIG. 1.

In the illustrated construction, the soundboard 24 is vertical and has a top edge 24*a*, a lower edge 24*b*, a vertical side edge 24*c* at the bass section of the soundboard and a vertical side edge 24*d* at the treble section. In accordance with one feature of the present invention, the top edge 24*a* of the soundboard is tightly coupled to a wood frame member 69*a* (FIG. 3) extending along the top of the piano, the bass side edge portion of the soundboard is disposed between vertical frame members 69*b*, 69*c* ( FIG. 5) while the vertical treble side edge portion is positioned between wood frame members 69*d*, 69*e* (FIG. 4). The wood frame members 69*a*, 69*b*, 69*c*, 69*d* and 69*e* are connected to the string frame by suitable screws with the wood frame members 69*a* being glued to the lower edge side of a wood plank 70 which in turn is secured to the pin plank 35.

In accordance with the present invention, the bass side edge and the top edge of the soundboard are tightly coupled to the adjacent wood frame as by gluing, while the lower edge of the soundboard is loosely coupled to the frame and in the preferred and illustrated embodiment, the bottom edge is free to vibrate independently of contact with the frame of the piano. The soundboard at the treble side is tightly coupled to the wood frame members 69*d*, 69*e*, but the latter preferably terminate short of the upper edge of the soundboard to provide a loose coupling of the portion of the treble side edge immediately adjacent the treble end of the bridge at the top edge of the piano. Also, the top edge of the soundboard may be loosely coupled to the adjacent top frame member for a relatively small portion of the length of the soundboard extending inwardly from the treble side edge.

By vibrationally freeing the soundboard adjacent the termination of bridge 40 at the treble edge 24*d*, particularly along the vertical side edge, the width of the piano can be reduced, and the attenuation of the treble tones is reduced which would otherwise normally occur if the treble end of a glued soundboard were completely secured to the wooden frame.

In accordance with a further feature of the present invention, a massive rib 90 is provided along the lower edge of the upper plate-like portion 31 of the string frame 22. Referring to FIG. 3, the massive rib 90 is shown in cross section and has a portion 90*a* extending perpendicularly from the plate-like portion 31. By positioning the massive rib on the cast iron plate-like portion 31 so that it is positioned generally below the string terminus blocks 38 along the complete string scale, certain tonal problems normally associated with smaller pianos, such as an upright piano, are minimized or eliminated. Conventionally, upright pianos have a generally shallow tonal quality. The rib promotes production of good treble tone and also improves the tone in the mid-range. While a grand piano has a small rib on the back side of the casting of the string frame, the function and location of the rib is to support the string load on the pin plank rather than to improve the tonal qualities of the piano.

By vibrationally freeing the lower edge 24*b* of soundboard 24, the bridge can be located as close to this edge as practical resulting in very good bass tones. This invention thus enables the bass strings to be made as long as possible without utilizing an excessive angle for the strings. Thus by freely suspending the soundboard 24 along its lower edge **24*b* and the upper portion of its treble edge 24*d* (FIG. 4**), while tightly coupling the other edges, the present invention maximizes the usable area and quality of a soundboard in a small piano.

The present invention produces a superior bass tone in an upright piano. Frequency response measurements of the bass bridge of a conventional upright piano has shown the frequency to attenuate rapidly below 120 Hz. Tests of the present invention show that the attenuation does not occur until below 75 Hz, which is approximately an octave better in frequency response for the bass notes. Audio tests to a trained ear show the present invention as having more uniformity in volume for the complete range of notes. The responsiveness of the present invention can be further demonstrated by dead spot detection. Prior art upright piano soundboards often have dead spots where the soundboard hardly vibrates at all. These dead spots can be located by slightly touching various areas of the soundboard during utilization of the instrument. In the present invention, no dead spots have been detected, the total area of the soundboard vibrates with great efficiency.

The preferred hammer strike line 84 is shown in dotted lines in FIG. 1; the strike line is a constant distance above the lower edge of the soundboard from the highest note to the lowest treble note and then is inclined upwardly to engage the bass strings progressively farther from the lower edge of the soundboard as it proceeds to the lowest bass note.

The design of the soundboard and its mounting is important to achieve its full tonal potential in the present invention. The soundboard is preferably tapered from 5/16 thick at the top to ¼ thick at the bottom which is conventional. The soundboard ribs are tapered from ⅞ square at the top to ⅞ wide × ⅜ thick at the bottom. The soundboard is rigidly secured to the frame in a axis normal to the strings, but the soundboard must be allowed freedom to flex rotationally along the secured edges. Thus, the ribs are terminated at the line where the soundboard is glued to the frame to permit the required rotational flexure of the soundboard. The thickness of the ribs changes across the soundboard, the ribs being thinner toward the treble end.

Due to the angle of the strings, at some note slightly above the mid range of the instrument, the angled soundboard ribs extend from the upper soundboard edge down to the lower side corner of the soundboard where the soundboard is glued to the frame. The treble soundboard in this generally triangular area vibrates in a diaphragmatic manner with the bridge being located in the vicinity of the center of the soundboard. The treble portion of the soundboard of the present invention thus vibrates similar to a conventional piano.

The upper end of the bridge must not be too close to the glued edge or these upper notes will be attenuated. In order to reduce the width of a piano, the end of the treble bridge may be placed up to the soundboard edge, if the soundboard along a portion of the edge near the bridge is completely free and not attached to the wooden frame.

An uncrowned or crowned soundboard may be employed, the latter providing possible improved tonal qualities. Also, with the lower edge of the board free, the borad is quite flexible, and the strings may have no bearing at all. In the treble portion where the board is supported on two sides of a triangle, a small amount of downbearing (1/64 to 1/32 in) is preferably used just to make certain that production tolerances do not result in an upbearing condition which would tend to lift the strings off the bridge.

Also, it has been discovered that the mass of the support for the vibrational end of the string, called the vee support, that is supported by the cast iron frame has a significant effect upon the tone, particularly in the upper treble. The upper strings on a grand piano are supported by a heavy cast cappo d'astro bar, but the casting on an upright has no such massive support. By positioning a massive rib onto the back side of the cast iron plate that is positioned generally beneath the string terminus support along the complete string scale the tonal quality is improved. A grand piano has a small rib on the reverse side of the casting that in some portions of the scale is generally beneath the string vee. This rib is used to support the string load on the pin plank. Most upright pianos, due to the different load bearing construction, do not need to hold the pin plank in place, and so the support rib does not exist. The carefully positioned and relatively massive rib in the present invention produces an outstanding treble tone, and also improves the tone in the mid range.

As previously mentioned, the angled strings in a vertical piano vibrates from the hammer blow with a vibrational component in the plane of the strings. This lateral vibration does not tend to drive the soundboard but it puts a lateral vibrational reaction force on the vee support at the upper end of the string. If the vee is a long ridge as is used in conventional upright pianos, the lateral motion of the string causes the string to vibrate sideways at the vee support and this slight motion gives an undesirable aspect to the tone. The tone does not sound solid and pure.

The best tone is achieved with vee notches of the type described into which the strings rest. The vee notches grip the string firmly so that the string cannot vibrate sideways in its support, and the tone is at an optimum.

The design of the present invention has significant cost advantages. In an overstrung piano, the treble strings angle downward to the left, and the bass strings angle downward to the right. The frame to support these strings has an X configuration that is not strong. The cast iron plate or frame is conventionally screwed to a heavy wooden back that helps to support the load. The wooden back is expensive to build because of materials and labor. Piano designers have tried to eliminate the back posts to save manufacturing cost, but the result is a weakened frame structure.

In the present invention, all the strings are parallel and thus the cast iron plate has parallel compression ribs. The result is a structure capable of supporting a high string load which is rigid and strong and which saves significantly in material cost by the elimination of the wooden back, and yet the frame is stronger and more rigid than a conventional piano.

The design of the string length scale in a vertical piano is a balance of many compromises. The critical height dimension of the piano is created by the length of the longest treble string. The length of this string is a function of the height of the hammer strike line above the floor and the overall height of the piano. The length of the lowest note in the piano is dependent upon the distance of the strike line above the floor and not necessarily upon the height of the piano. The length of the lowest string could often be longer were it not for the restriction of maintaining a constant strike line.

In the present invention, the height of the strike line preferably varies. The strike line of a conventional piano is a straight line from the top to the bottom notes. In the present invention the strike line is straight and a constant height above the floor from the top note to the lowest treble note. The strike line slopes slightly upwardly from this note to the bottom note. The strike point of the lowest note may be ½ in or so above the treble strike line. This upwardly sloping strike line enables the bass strings to be as long as the height of the piano will permit. Thus, the length of the bass strings is greater than would be possible with a straight strike line.

This rising strike line in the bass register means that the length of the hammer shanks increased toward the bottom note because the hammer pivot line is always a straight line. This lengthening of the bass hammer shanks actually results in a more powerful hammer blow being imparted to the bass notes. The result is a good feel to the bass by the musician.

What is claimed is:

1. A string instrument comprising a string frame, a plurality of strings tensioned on said string frame, a soundboard having a first edge portion extending transversely of said strings adjacent one of the ends of said strings and coupled to said frame, a second edge portion extending transversely to said strings at the other ends thereof and suspended vibrationally free of said string frame to vibrate independently of contact with said frame, a third edge portion extending between said first and second edge portions and coupled to said frame along substantially its entire length, and a fourth edge portion extending between said first and second edge portions and having a first part adjacent to said second edge portion and coupled to said frame and a second part thereof adjacent to said first edge portion, and bridge means extending transversely of said strings adjacent said other ends of said strings and coupling said strings to said soundboard, said bridge means having a bass end terminating adjacent said second edge portion and a treble end terminating adjacent said second part of said fourth edge portion so the efficiency and tonal qualities of said soundboard are maximized for a given area.

2. A string instrument comprising a string frame, a plurality of strings tensioned on said string frame, a soundboard having a first edge portion extending transversely of said strings adjacent one of the ends of said strings and coupled to said frame, a second edge portion extending transversely to said strings at the other ends thereof and suspended vibrationally free of said frame, a third edge portion extending between said first and second edge portions and coupled to said frame along substantially its entire length, and a fourth edge portion extending between said first and second edge portions and having a first part adjacent to said second edge portion and coupled to said frame and a second part thereof adjacent to said first edge portion and suspended vibrationally free of said frame, and bridge means extending transversely of said strings adjacent said other ends of said strings and coupling said strings to said soundboard, said bridge means having one end thereof terminating adjacent said second edge portion and the other end thereof terminating adjacent said second part of said fourth edge portion so the efficiency and tonal qualities of said soundboard are maximized for a given area.

3. A string instrument as claimed in claim 2 wherein said string frame includes a massive support rib extending along an edge adjacent to said first edge portion of said soundboard and generally below string speaking length termini along a complete string scale.

4. A string instrument as claimed in claim 3 including a terminus device defining one end of a speaking length of at least one string and said bridge means on said soundboard defining the other end of the string speaking length, said terminus device comprising string seat means engaging said string at circumferentially spaced points located at opposite sides of a plane containing the longitudinal axis of the string and disposed perpendicular to the soundboard.

5. A string instrument as claimed in claim 4 wherein each of said seat means comprises notch means presenting diverging opposite side edges engaging the string.

6. A string instrument as claimed in claim 5 including a hammer strike line being a constant distance above said second edge of said soundboard for a portion thereof adjacent said fourth edge of said soundboard and being inclined upwardly for a remaining portion thereof to engage bass strings at an increasing distance above said second edge of said soundboard.

* * * * *